United States Patent [19]

Samaniego

[11] Patent Number: 4,847,924

[45] Date of Patent: Jul. 18, 1989

[54] TOILET FLUSH AID

[76] Inventor: Joseph Samaniego, 4736 Admirlty Wy., Marina Del Rey, Calif. 90295

[21] Appl. No.: 140,398

[22] Filed: Jan. 4, 1988

[51] Int. Cl.[4] ..... E03D 5/08

[52] U.S. Cl. ..... 4/249; 4/308

[58] Field of Search ..... 4/250, 251, 249, 308

[56] References Cited

U.S. PATENT DOCUMENTS

| | | | |
|---|---|---|---|
| 1,005,075 | 10/1911 | Rosenstock | 4/249 |
| 1,585,557 | 5/1926 | Miller | 4/249 |
| 1,589,353 | 6/1926 | Bock et al. | 4/249 |
| 1,614,346 | 1/1927 | Coret | 4/308 X |
| 1,864,827 | 6/1932 | Jenkins | 4/249 |
| 2,204,867 | 6/1940 | Rehback | 4/249 UX |
| 2,467,019 | 4/1949 | Farson | 4/308 |
| 3,314,084 | 4/1967 | Balikjian | 4/249 |
| 3,624,845 | 12/1971 | Vorgang | 4/249 |
| 3,883,904 | 5/1975 | Wittman | 4/249 |
| 4,007,499 | 2/1977 | Lin | 4/249 |

*Primary Examiner*—Stuart S. Levy
*Assistant Examiner*—Steven M. du Bois
*Attorney, Agent, or Firm*—William H. Maxwell

[57] ABSTRACT

A flush handle operator for independent installation at a toilet and operating the same through a foot pedal activated assembly and an activating assembly having a member engaged over the flush handle, and with a cable interconnection between the two assemblies.

4 Claims, 2 Drawing Sheets

TOILET FLUSH AID

BACKGROUND OF THE INVENTION

This invention relates generally to a device for flushing toilets by means of a pedal member located near the floor or by the side of the toilet and equipped with a handle for manual flush operation. Prior art toilet flushing devices currently used are equipped with a handle which activates an internal embodiment or system to flush the toilet. There is another flush device comprised of a button on the floor to activate a flush system located under the floor surface. The general idea is excellent, however its results are impractical because of the high cost, and particularly its service which must be performed by trained technicians not always available in all locations. Furthermore, the entire system must be located under the floor surface, which in some cases conflicts with building structure, and with the performance of urgent repairs.

A mechanical assembly is provided which comprises means for foot operation of the flush handle as it exists on current toilets. The mechanical assembly is enclosed in a narrow supporting frame and protective cover, and vertically attached to the wall structure at or which supports a toilet. No direct connection to any member of the toilet installation is necessary.

Brief pressure on a foot pedal member transmits vertical motion to an activating member located just above the existing flush handle of the toilet, by an internal interconnecting cable attached to both members. One significant feature of the mechanical assembly in its easy installation, which may be performed by almost any one provided with common hand tools. Adjustment to operate existing flush systems, regardless of their distance of the flush handle from the floor surface is provide for and is accomplished by trimming the housing support frame and protecting cover. The assembly here presented conforms with all toilet installations known by this inventor. However, if future toilets provided with flush handles deviate from the present ones, provision for such changes have been considered. As an example, an extra wide commode will require a longer direct activating member which will be a simple change, and available.

SUMMARY OF THE INVENTION

It is an object of this invention to provide an inexpensive device which allows flushing a toilet by avoiding manual use of the existing flush handle. This feature is intended to prevent the possible transmission of venereal deseases by germs left on the surface of the flush handle by previous users, if such user was infected. This condition is aggravated when small children use public toilets. These objectives are accomplished by means of a support member attached to a wall independent of the toilet for the support of the mechanical assembly operated by a pedal member to rotate an actuating member that activates the flush handle. The actuating member is pulled by a flexible cable from the pedal member and extended vertically to the activating member to rotate the same, there being a buffer member thereon to activate the flush handle. This mechanical assembly is operable with the flush handles as shown in FIGS. 1 and 2 and the like.

The foregoing and various other objects and features of this invention will be apparent and fully understood from the following detailed description of the typical preferred forms and applications thereof, throughout which description reference is made to the accompanying drawings.

THE DRAWINGS

Figure 2:
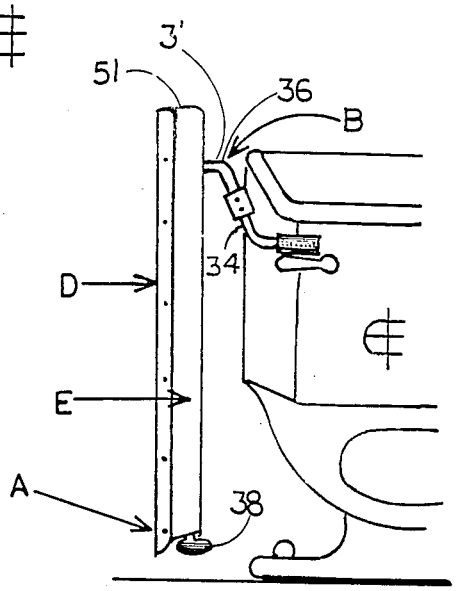
FIG. 2 is a perspective view showing the arrangement of the Toilet Flush Handle Operator applied to a toilet designed for both urination and defacation.
Figure 8:
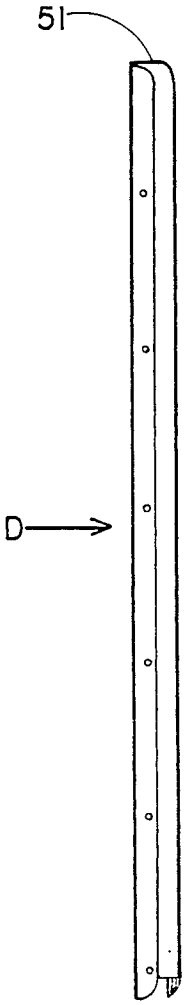

And, FIG. 8 is a perspective view of the overlying protecting cover that encloses the mechanical assembly as shown in FIG. 2.

PREFERRED EMBODIMENT

The Toilet Flush Handle Operator mechanical assembly is comprised of five interdependent embodiments suitable for fabrication of non-corrosive metals, such as stainless steel and nickle plated brass. The recited embodiments are as follows and include; a pedal activated assembly A, a direct activator assembly B, a steel cable embodiment C interconnecting assemblies A and B, a housing support member D, and an overall cover member E.

Referring now to the drawings, an embodiment of the invention is shown in which the Toilet Flush Handle Operator is fastened to the wall structure behind the toilet, as shown. Vertical foot pressure on a pedal member 38 applies vertical motion to a direct activating member 3 by their attachment to each end of the interconnecting cable member 22, and which vertical motion of the direct activating member 3 results in activation of a flush handle common in toilets currently used. Although only one mechanical assembly of this invention is illustrated in the drawings, this inventor contemplates any configuration and design of components which will accomplish the equivalent results. As an example, the recited direct activating embodiment shown in FIG. 4 may be manufactured as an integral part of the typical flush valve assembly currently attached to toilets.

Figure 7:
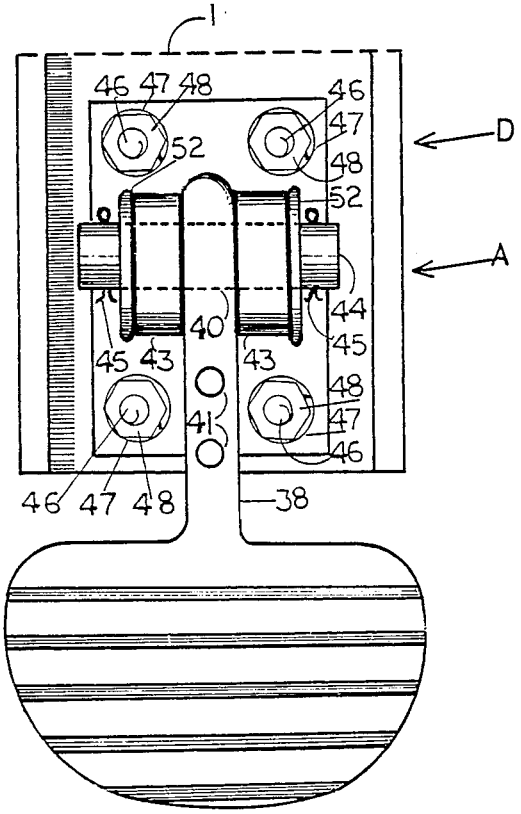
FIG. 7 is an enlarged view showing the foot operated pedal at the lower end of the housing support member shown in FIGS. 1 and 2.

The pedal activated assembly A is best illustrated in FIG. 7 and is shown to comprise a support bracket 42 fastened to a housing support member 1 attached to the wall structure behind the toilet. Bracket 42 is fastened to the member 1 as by screws 46 and nuts 48 with lock washers 47, at its four corners. The pedal member 38 has a flat end and a cylindrical portion with a bearing opening 40 for support upon a cylindrical member 44 carried by and between rectangular posts 43 located parallel to each other on the bracket 42. The cylinder member 44 is received in bearing openings in the posts 43 and secured there by cotter pins 45 with washers 52. Two small openings 41 are located perpendicularly from the axial center of the cylinder portion of the member 38, to connect the lower end of the cable embodiment C. As shown, the pedal actuated assembly A is positioned by the housing support member 1 to be at and above the floor level.

Figure 1:
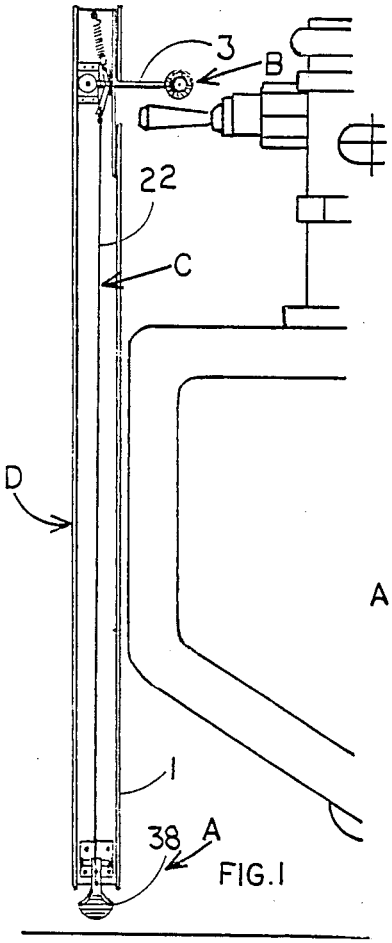
FIG. 1 is a front view showing the uncovered assembly of the Toilet Flush Handle Operator installed to activate the flush handle of a men's urinal toilet.

The direct activating assembly B varies in design as shown in FIGS. 1 and 2 of the drawings, the former activating member 3 adapted to use with lateral flush handles of urinal standpipes, and the latter activating member 3' adapted to use with front exposed flush handles of flush tank toilets. Both embodiments have the same basic features and comprised of a support bracket 5 fastened to the housing support member 1 by screws 11 and nuts 9 with lock washers 10, at its four corners. A direct actuating member 3 (3') has a straight end and an augmented annular portion 4 with a bearing opening at its axis center for support upon a bolt 6 secured by nuts 8 with washers 7, for semi rotation at a vertical face of bracket 5. Member 3' also has an opposite end having a 90° bend 36 parallel to the end thereof supported by the bolt 6 and its annular portion 4. A buffer member 24 is carried by the 90° portion of the activating member 3, and a buffer member 35 is carried by the second 90° bend parallel to the end at bolt 6 (see FIG. 3).

A tubular member 32 with set screws 33 securing an extension member 34 and adjusting the first bend actuating member with respect to the end portion having the second bend, to position the end thereof to engage the flush handle of the toilet.

Figure 4:
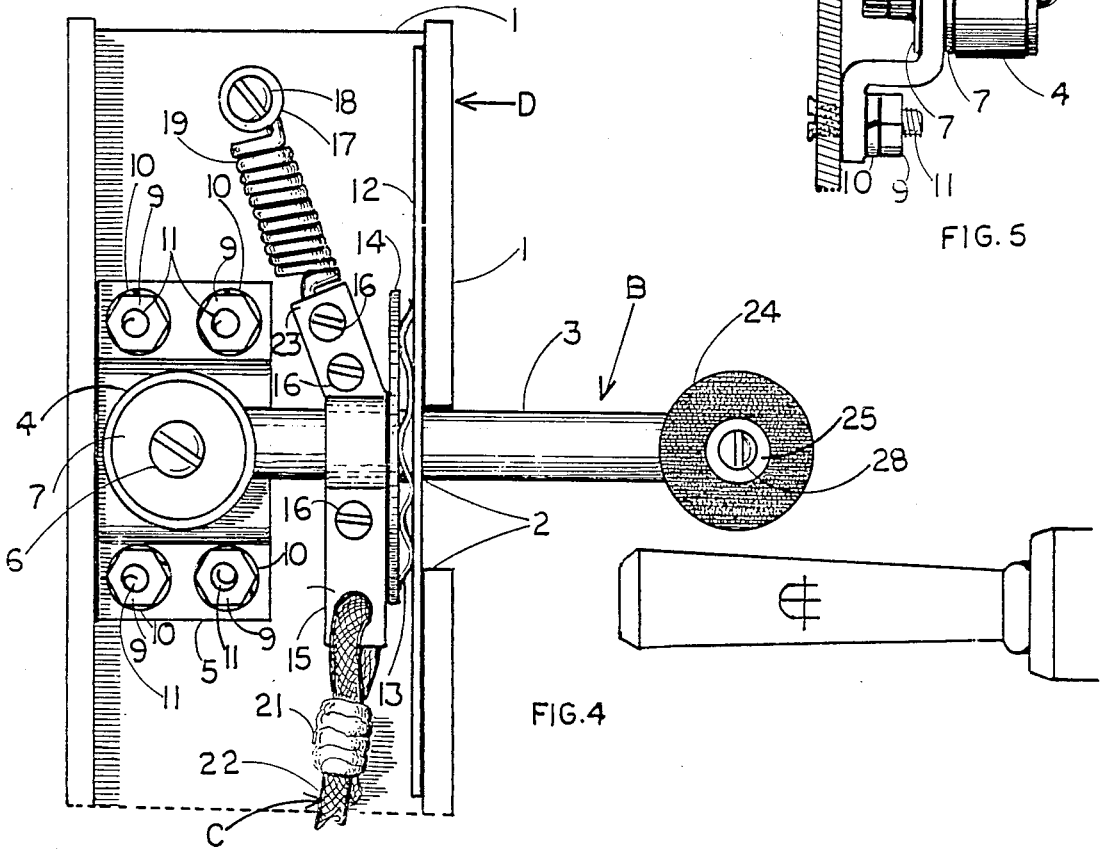
FIG. 4 is an enlarged front view showing the activating member embodiment of FIG. 1, which toilet comprises a standpipe that mounts a lateral flush handle, and showing means to return to a dead position.
Figure 6:
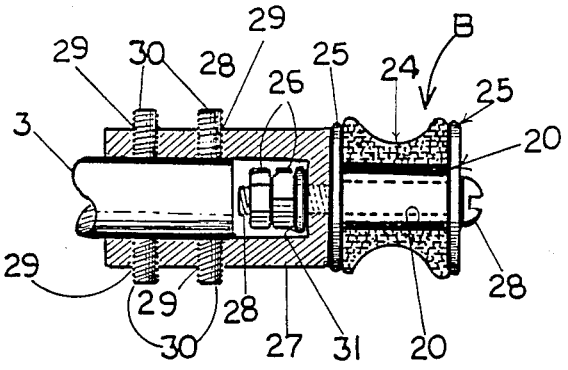
FIG. 6 is an enlarged detailed side view of the buffer member which is attached to the free end of the activating member.

In the FIG. 1 embodiment, the direct actuating member 3 carries the buffer member 24 on the 90° bend (36) as detailed in FIGS. 4 and 6 of the drawings. The buffer member provides a cushion contact between the end of member 3 and the cylindrical outer surface of the lateral flush handle. Prevention of lateral displacement of the flush handle is by a concave configuration of a semi-hard plastic wheel having a tubular bearing member 20 rotatable on the shank of a screw 28. Screw 28 is carried by a blocked end 31 of a supporting tubular member 27 having set screws 30 in threaded openings 29 to adjust the member 27 at the end of activating member 3. Washers 25 prevents horizontal displacement of the buffer member 24 from the flush handle.

Figure 3:
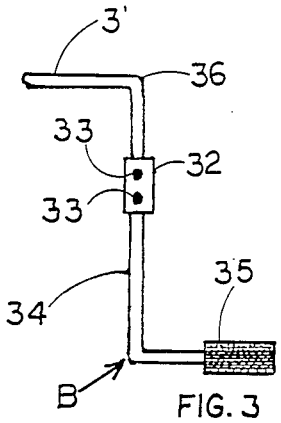
FIG. 3 is an enlarged plan view showing an extension member to the actuating member of the toilet of FIG. 2, which toilet comprises an integral water reservoir equipped with an internal flush system with a forwardly exposed activating flush handle.
Figure 5:
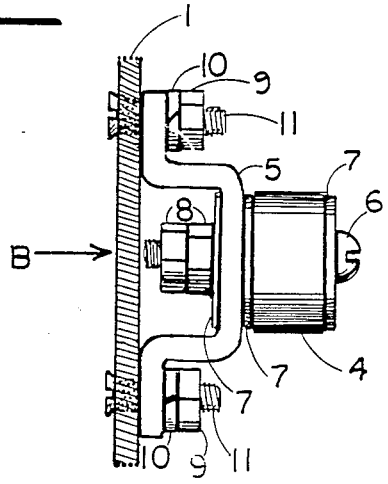
FIG. 5 is a sectional side view showing the activating member support of FIG. 4 for semi-rotational motion of the direct activating member.

In the FIG. 2 embodiment, the direct activating member 3' carries the buffer member 35 on the second 90° bend as detailed in FIG. 3 of the drawings. As shown, there are two 90° bends 36, so that the end of the direct activating member 3' is parallel to the portion thereof carried by bolt 6. The buffer member 35 is of semi-hard plastic snug over the end of said member, to provide a cushion contact between the end of member 3' and the outer surface of the front facing flush handle.

The steel cable embodiment C interconnecting the assemblies A and B is comprised of a cable member 22 connected to and between the pedal member 38 and the direct activating member 3 (3'), as shown. The lower end of the cable is inserted into the two openings 41 of the pedal member 38, forming a loop secured by a crimped collar member 21. The upper end of the cable is secured into an opening 23 in a clamp 15 on member 3 (3'), forming a loop secured by a crimped collar 21. The clamp 15 is a double clamp which comprises opposite fastening ends, an end with the above described lower opening 23, and an end with an upper opening 23, as shown. The double clamp 15 is secured onto member 3 (3') by two screws 16, spaced from the axis of bolt 6, as shown. A spring member 19 returns the members 3 (3') and 38 to a dead position, as shown in FIG. 4, the spring extending between the upper opening 23 and a screw 18 inserted through the back plate of the housing support member 1, with a washer 17, as shown.

The direct actuating member 3 (3') operates through one side of the housing support member 1 as best illustrated in FIG. 4. An opening 2 in member 1 passes the member 3, there being a rectangular shield 12 over member 3 (3') and held against the inside of the housing support member by a spring washer 13 operating against a washer 14 positioned against clamp 15, as shown. The opening 2 limits upward movement of member 3 (3'). The direct activating member 3' moves the same as member 3 as it extends from one side of the housing support 1 with its parallel 90° end overlying the toilet front.

The housing support member D is a channel shaped member as shown, and has a back plate for attachment to the wall by means independent from the toilet.

The overall cover E is an overlying member 51 that encloses the mechanical assembly, and is fastened over the housing support member 1 as shown.

From the foregoing it will be seen that I have provided a very practical mechanical assembly for the direct activation of the flush handle on existing toilets, independently installed without attachment to the toilets. As a result, foot operation is substituted for hand operation, whereby the spread of desease by hand manipulation is avoided.

Having described only the typical preferred forms and applications of my invention, I do not wish to be limited or restricted to the specific details herein set forth, but wish to reserve to myself any modifications or variations that may appear to those skilled in the art, as set forth within the limits of the following claims.

I claim:

1. A toilet flush handle operator for foot operation to activate the flush handle of the toilet, and comprised of a mechanical assembly including;

a housing support member with means for attachment to a side of a wall at and independent of the toilet, a pedal activated assembly having a pedal member at and above a floor level, the pedal member being rotatable on a turning axis in a bracket fastened to the housing support member, an activating assembly having an activating member over and extending from one side of the housing support member and with an end portion spaced above the pedal member and carrying a rotatable buffer member to engage and depress the flush handle of the toilet, the activating member being carried to turn on an axis in a bracket fastened to the housing support member, and a cable interconnection member between the pedal member and activating member, whereby activation of the flush handle is by foot operation and avoiding hand operation.

2. The toilet flush handle operator as set forth in claim 1, wherein the activating member extends through an opening in and from one side of the housing support member there being a spring biased shield carried by the activating member to engage with the housing support member and close said opening around the activating member.

3. The toilet flush handle operator as set forth in claim 1, wherein the activating member extends from one side of the housing support member and has a first bend to an end portion having a second bend parallel to said member that extends from said one side, and wherein a tubular member over the first bend is secured with set screws and to an extension member that adjusts the first bend actuating member with respect to the end portion having the second bend to position the end thereof to engage the flush handle of the toilet.

4. The toilet flush handle operator as set forth in claim 1, wherein the activating member extends from one side of the housing support member and has a first bend to and end portion having a second bend parallel to said member that extends from said one side, and wherein a tubular member over the first bend is secured with set screws and to an extension member that adjusts the first bend activating member with respect to the end portion having the second bend to position the buffer at the end thereof to engage the flush handle of the toilet.

* * * * *